US008465315B2

(12) United States Patent
Matsumoto et al.

(10) Patent No.: US 8,465,315 B2
(45) Date of Patent: Jun. 18, 2013

(54) PRINTED CIRCUIT BOARD CONNECTOR

(75) Inventors: Hiroyuki Matsumoto, Kanagawa (JP); Shinya Masada, Kanagawa (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 28 days.

(21) Appl. No.: 13/313,330

(22) Filed: Dec. 7, 2011

(65) Prior Publication Data

US 2012/0149228 A1 Jun. 14, 2012

(30) Foreign Application Priority Data

Dec. 13, 2010 (JP) ..... 2010-276567

(51) Int. Cl.
*H01R 13/62* (2006.01)

(52) U.S. Cl.
USPC ..... 439/329

(58) Field of Classification Search
USPC ..... 439/329, 660, 79, 924.1, 941
See application file for complete search history.

(56) References Cited

U.S. PATENT DOCUMENTS

| | | | | |
|---|---|---|---|---|
| 6,280,240 | B1 * | 8/2001 | Chang | 439/495 |
| 7,837,492 | B2 * | 11/2010 | Zhu | 439/329 |
| 7,938,672 | B2 * | 5/2011 | Zhu | 439/374 |
| 8,070,526 | B2 * | 12/2011 | Zhu | 439/660 |
| 2011/0043236 | A1 * | 2/2011 | Ng | 324/756.01 |

FOREIGN PATENT DOCUMENTS

JP 2001-35603 2/2001

* cited by examiner

*Primary Examiner* — Jean F Duverne
(74) *Attorney, Agent, or Firm* — Kratz, Quintos & Hanson, LLP

(57) ABSTRACT

A printed circuit board connector is equipped with a housing and plurality of contacts. The housing has an insertion chamber 11 inserted by the mating-side connector, and a plurality of contact-insertion holes inserted by the contacts. The contact has a base portion, a contact-connecting portion that connects with a mating-side contact, and a lead portion that is solder-bonded to the printed circuit board. The base portion and the housing have a contact lance and level that engage with each other so that the contact does not move in an insertion direction to the contact insertion hole or a reverse direction, and the contact lance and level swingably hold the base portion inside the contact-insertion hole so that the lead portion approaches and separates from the printed circuit board surface.

4 Claims, 11 Drawing Sheets

PRINTED CIRCUIT BOARD CONNECTOR

This application is based on and claims the benefit of priority from Japanese Patent Application No. 2010-276567, filed on 13 Dec. 2010, the content of which is incorporated herein by reference.

BACKGROUND OF THE INVENTION

1. Field of the Invention

The present invention relates to printed circuit board connectors. The present invention particularly relates to a printed circuit board connector structure to which a plurality of contact leads can be securely solder-bonded to a printed circuit board surface.

2. Related Art

A shell formed by a metallic plate composes an outer shell of a connector on a printed circuit board connector, for example. A part of the shell is solder-bonded to a surface of the printed circuit board as a reinforcing tab extending from the outer shell to improve connector strength.

However, in a plan view, this kind of reinforcing tab extends outward from the connector shell occupying a certain amount installation space on the printed circuit board. This causes a problem of reduced space for mounting other electronic components.

To resolve this kind of problem, a printed circuit board connector was disclosed in Japanese unexamined patent publication 2001-35603 (hereinafter referred to as pat. pub. 1) that was compact and achieved a reduced height, reduced connector occupying space at a mounting surface of the printed circuit board, and ensured connector strength.

FIG. 16 is an exploded perspective assembly view of the printed circuit board connector described in pat. pub. 1, showing the housing and contacts opposingly disposed. FIG. 16 in this application corresponds to FIG. 3 of pat. pub. 1.

The following refers to FIG. 16. The printed circuit board connector 90 (hereinafter referred to as the connector) according to pat. pub. 1 is equipped with insulated housing 7, and a plurality of contacts 9. The housing 7 includes a back-wall portion 71 and a pair of side-wall portions 72, 72. A plurality of contact insertion holes 71*a* is formed in the back-wall portion 71 along a length direction thereof. The pair of side-wall portions 72, 72 extends from both ends of the back-wall portion 71 toward a forward direction. The plurality of contacts 9 is press-fitted into the contact insertion holes 71*a* in the housing 7.

Furthermore, as shown in FIG. 16, the contact 9 includes a lead portion 9*b* bent substantially to a right angle extends parallel to a contact-connecting portion 9*a* and in a direction opposite to the contact-connecting portion 9*a* from the back-wall portion 71. The lead portion 9*b* is solder-bonded to a surface (mounting surface) of the printed circuit board, not shown. That is to say, the connector 90 is a surface-mount type printed circuit board connector.

The following refers to FIG. 16. The drawing clearly shows that a width of the contact-connecting portion 9*a* base-end portion is wider than a leading end portion side thereof. Also, a pair or barbs 9*c*, 9*c* is formed at the base-end portion of the contact-connecting portions 9*a*. The contact 9 is inserted until shoulders 9*s* disposed at the base-end portion of the contact-connecting portion 9*a* abut a back of the contact insertion hole 71*a*. While the contact 9 is being inserted, the pair of barbs 9*c*, 9*c* bite into the inner walls while scraping along an inner wall of the contact insertion holes 71*a*, thereby securely fastening the contact 9 in the housing 7.

The following refers to FIG. 16. It is easy precisely to form a pitch between electrodes on the contact 9 or the contact insertion hole 71*a*. However, because the housing 7 is formed from plastic, thermal strain can causes warping in a length direction of the back-wall portion 71. For that reason, there is a problem that co-planarity cannot be ensured for the solder joint surfaces of the plurality of lead portions 9*b*.

Conversely, while it is possible to correct the plurality of lead portions 9*b* to ensure predetermined co-planarity for these solder-bonded surfaces, printed circuit board warping still sometimes occurs. Therefore, while the plurality of lead portions 9*b* may be in contact with the printed circuit board surface at both end portions, for example, there is a problem in that the lead portions 9*b* may become slightly separated from the printed circuit board surface at a central portion if warping occurs, for example. This makes it difficult to obtain a uniform solder thickness.

SUMMARY OF THE INVENTION

An object of the present invention is to provide a printed circuit board connector wherein solder-bonded surfaces of lead portions of contacts arranged in parallel in a longitudinal direction of the housing contact the printed circuit board uniformly, and that improves connector mounting quality by making a uniform solder bonding thickness.

In a first aspect of the present invention is a printed circuit board connector equipped with a housing and a plurality of plate-shaped contacts arranged in parallel in the housing, mounted on a printed circuit board surface. The housing includes insertion chambers one face thereof is open to enable insertion of a mating-side connector, contact insertion holes allowing insertion of contacts, open in a direction opposite to the insertion holes, penetrating the insertion chamber. The contact includes a base portion held inside contact insertion holes, a contact-connecting portion, a width thereof being narrower than the base portion, disposed to project into the insertion chamber extending from the base portion to an end side, a contact lead at an other end of the base portion being bent and extending at a bottom surface side of the housing, further bent and extending in parallel to the contact-connecting portion at an opposite side of the contact-connection portion; locking means that locks the contact base portion and the housing so that the contact does not move in an insertion direction to the contact insertion holes or a reverse direction. The locking means swingably holds the contact base portion inside the contact-insertion holes so that the lead portion approaches and separates from the printed circuit board surface.

The housing has insulating properties. It is acceptable for housing with insulating properties to be composed of a non-conductive material. It is also possible to attain insulated housing having a predetermined shape by being formed from a synthetic resin.

The contacts have conductive properties. It is possible to attain conductive contacts having predetermined shapes by punch-forming or fold-forming a conductive metal plate. In view of the ease of forming, spring characteristics, and conductivity and the like, a copper alloy, for example, is preferred to be used for contacts. However, the invention is not to be construed to be limited to copper alloy.

The contacts can be a bellows type, or they can be disposed so that the contact-connection portion faces an insertion chamber. When a mating-side connector is inserted into the insertion chamber, the contact-connection portion touches the mating-side contact enabling an electrical connection between the contacts and the mating-side connector. The lead portion can be solder-bonded to a printed circuit board surface. This means that the lead portion surface can be solder-bonded to a pad (or a pattern) formed on a surface of the printed circuit board.

Locking means swingably holds the contact-base portion at an inside of the contact-insertion hole. This means that the contact-base portion is held maintaining a contact margin and looseness, without any significant change in contact posture. In other words, it held in a floatable manner, and the contacts have a predetermined degree of freedom in the housing.

One side of the contact and housing locking means includes part or a member that projects from a member, such as a protrusion, or convexity, or a bump and the like, and can include a hook, a barb or a return. The other side of the locking means can include a part or a member that projects in the same way to a projecting part or a member disposed on the one side of the locking means. A part or member can be included that receives the projecting part or a member such as a level or concavity, and a mechanical engaging element can be included.

The locking means of the contact and the housing can be a lance-shaped or a wedge-shaped projection. This is generally called a lance. This locking means engages to stop the contact in a storage chamber in a predetermined range of movement, and prevents the contact from falling from the storage chamber. A lance can be disposed on the contact. In such a case, this type of lance is called a contact lance. The lance can also be disposed in the housing. In such a case, this type of lance is called a housing lance.

The lead portion is close to or separated from the printed circuit board surface. This means that each lead portion independently moves toward the printed circuit board surface (solder-bonded surface), with a plurality of contacts built in the housing. For example, if a bottom surface (the surface contacting the printed circuit board) of the housing is slightly curved to an inside in a concave shape, the lead portion positioned near the center of the housing will be movable. It will be able to approach the printed circuit board side, and the lead portion positioned near both sides of the housing will be movable to separate from the printed circuit board.

It is conceivable that a force in the melted solder acts on the lead portions to attract them to the pad side where the lead portions are solder-bonded to pads on the printed circuit board. The connector for the printed circuit board according to the present invention can be said to be self-aligning.

The printed circuit board connector according to the embodiment of the present invention is structured to hold a plurality of contacts having lead portions solder-bonded to the printed circuit board to be able to swing in only one direction on the printed circuit board. For that reason, the plurality of lead portion solder-bonding surfaces is solder-bonded along warping or twisting that occurs. They are able to absorb manufacturing error caused by warping or torsion of the housing or printed circuit board. Furthermore, it is possible to reduce the effects on lead portion solder-bonding strength. Specifically, mounting quality of the connector is improved.

According to the present invention, locking means of the first embodiment includes a first engaging member having a contact lance equipped with a hook-shaped latching piece at a leading end portion thereof, extending substantially parallel to the base portion from another end side of the base portion toward one end side, and a second engaging member that communicates with contact insertion holes, and has a level in which the latching piece engages in the housing, formed by an elongated hole that can be inserted by the contact lance, and is formed at a back of the elongated hole.

According to the present invention, locking means of a second embodiment includes a third engaging member including a housing lance disposed in the housing, that projects from another face of the housing, and turns over to oppose an inner wall of the contact insertion hole, and a fourth engaging member having a rectangular notch portion disposed on the contact, in which the leading end of the housing lance can engage, partially forming on the base portion.

The printed circuit board connector according to the embodiments of the present invention includes a first contact insertion hole group including a plurality of contact insertion holes arranged in a row at a top level of another surface of the housing, and a second contact insertion hole group including a plurality of contact insertion holes arranged in a row at a bottom level of another surface of the housing. Also included are first contact whose leg portion is longer from the base portion to the lead portion, disposed in plurality, and inserted into the contact holes of the first contact insertion hole group, and a second contact whose leg portion is shorter from the base portion to the lead portion, disposed in plurality, and inserted into the contact holes of the second contact insertion hole group, the first and the second contacts include the leg portion and the lead portion, alternately arranged at another end side of the base portion.

The present invention solves the aforementioned problem by disposing a contact lance at a base end portion of a contact-connecting portion, and swingably anchoring the contact inside of the contact insertion holes, or by disposing a housing lance at an inside portion of the contact insertion holes and swingably anchoring the base end portion of the contact-connecting portion.

BRIEF DESCRIPTION OF THE DRAWINGS

FIG. 15A is a perspective view of the first contact; FIG. 15B is a perspective view of the second contact.

DETAILED DESCRIPTION OF THE INVENTION

The present invention solves the aforementioned problem by disposing a contact lance at a base end portion of a contact-connecting portion, and swingably anchoring the contact at an inside of the contact insertion holes, or by disposing a housing lance at an inside portion of the contact insertion holes and swingably anchoring the base end portion of the contact-connecting portion. Preferred embodiments of the present invention will now be explained with reference to the drawings provided.

First Embodiment

Printed Circuit Board Connector Configuration

Figure 1:
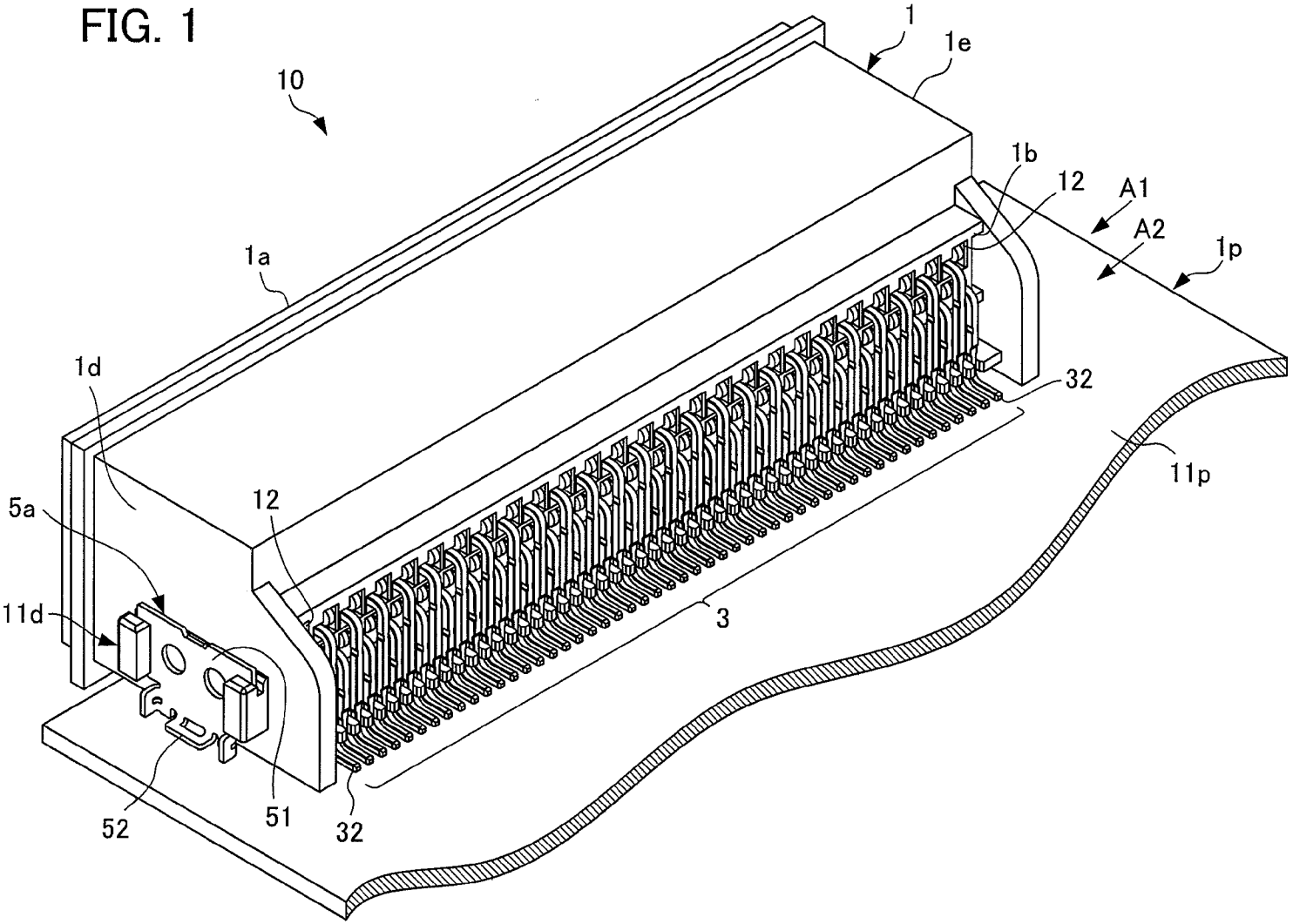
FIG. 1 is a perspective view of a printed circuit board connector configuration according to a first embodiment of the present invention with the printed circuit board connector seen from a top surface side.
Figure 2:
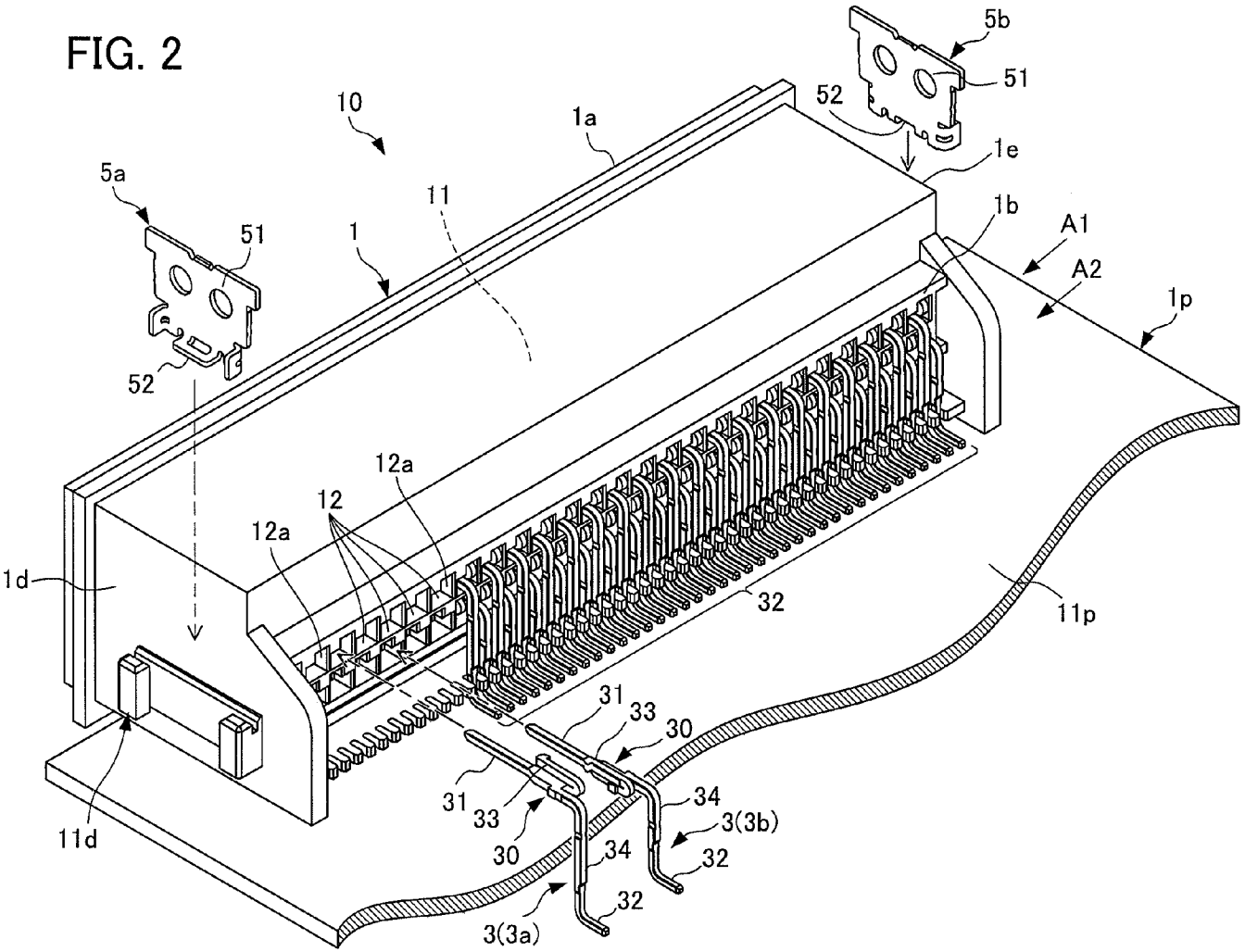
FIG. 2 is an exploded perspective view of the printed circuit board connector configuration according to the first embodiment with the printed circuit board connector seen from a top surface side.

First, the printed circuit board connector configuration according the first embodiment of the present invention will be explained. FIG. 1 is a perspective view of a printed circuit board connector configuration according to the first embodiment of the present invention with the printed circuit board connector seen from a top surface side. FIG. 2 is an exploded perspective view of the printed circuit board connector configuration according to the first embodiment with the printed circuit board connector seen from a top surface side.

Figure 3:
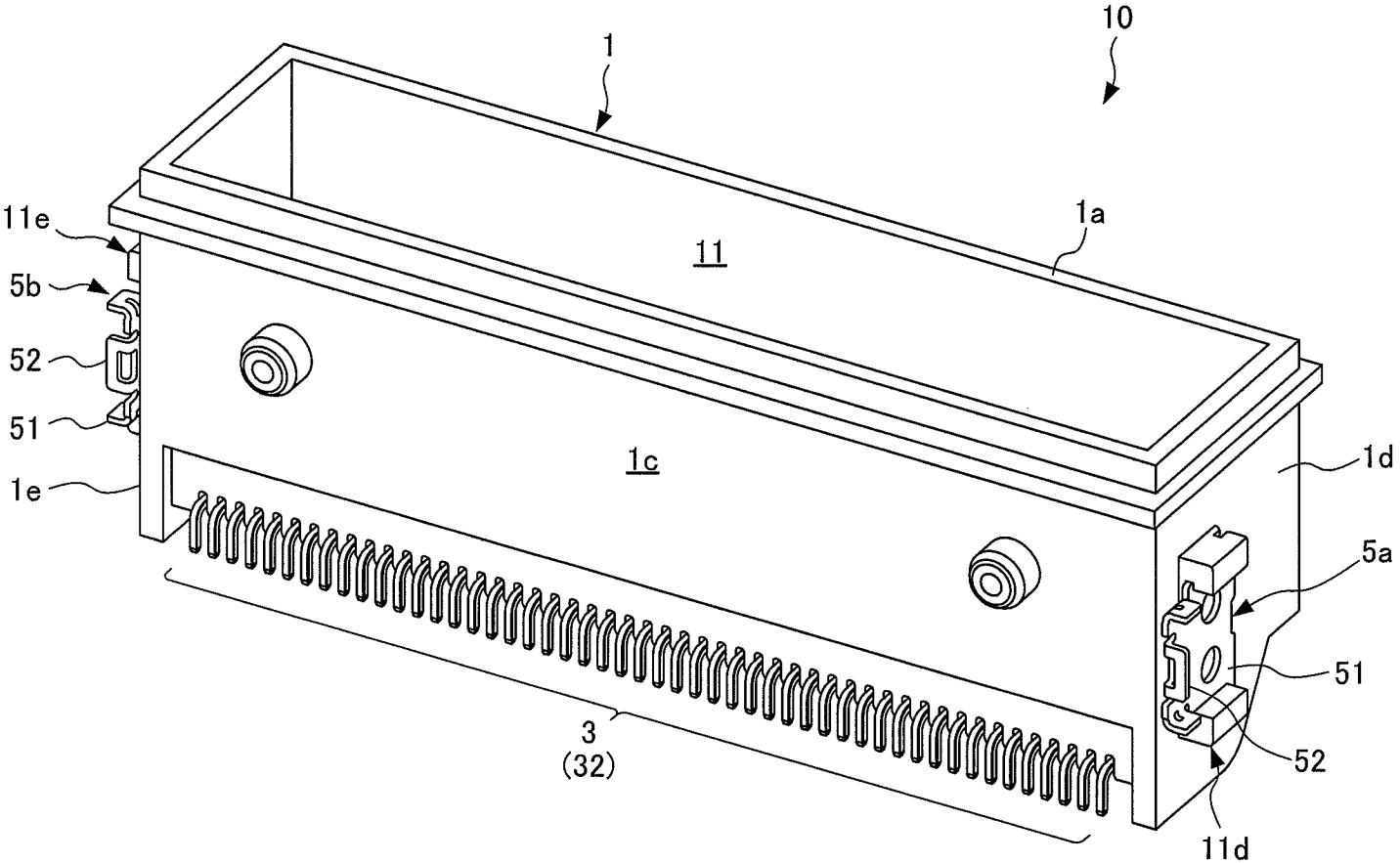
FIG. 3 is a perspective view of the printed circuit board connector configuration according to the first embodiment with the printed circuit board connector seen from a bottom surface side.
Figure 4:
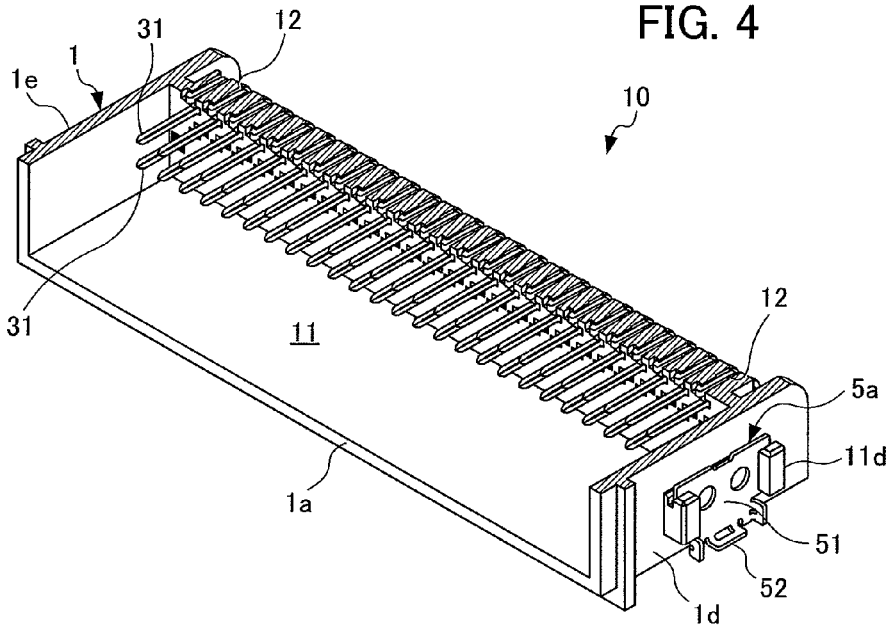
FIG. 4 is a perspective view of the printed circuit board connector according to the first embodiment, showing a cross-section of the housing.

FIG. 3 is a perspective view of the printed circuit board connector configuration according to the first embodiment with the printed circuit board connector seen from a bottom surface side. FIG. 4 is a perspective view of the printed circuit board connector according to the first embodiment, showing a cross-section of the housing.

Figure 5:
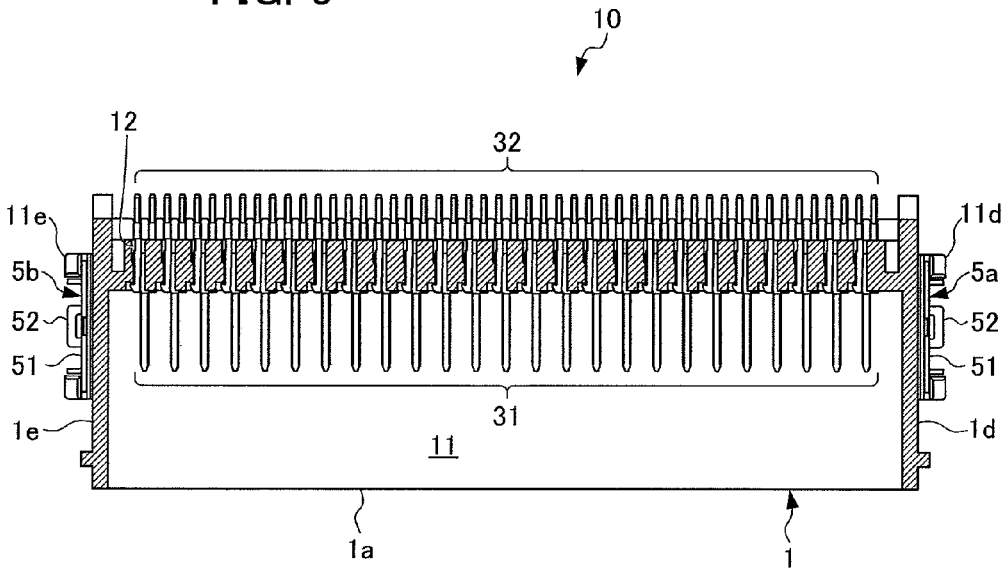
FIG. 5 is a plan view of the printed circuit board connector according to the first embodiment, showing a cross-section of the housing.
Figure 6:
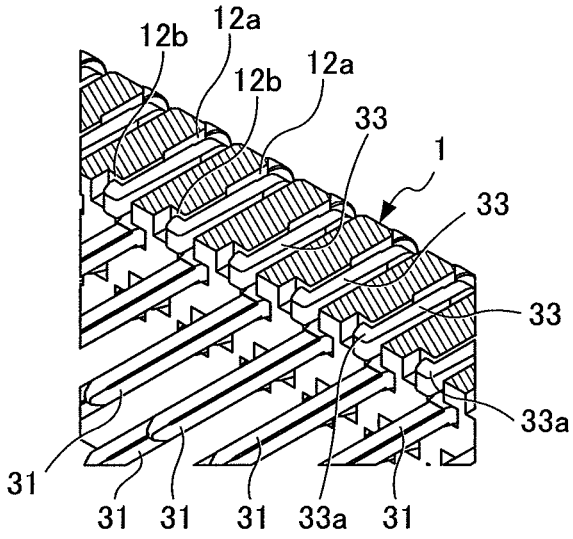
FIG. 6 is an expanded perspective view of an essential portion of FIG. 4.
Figure 7:
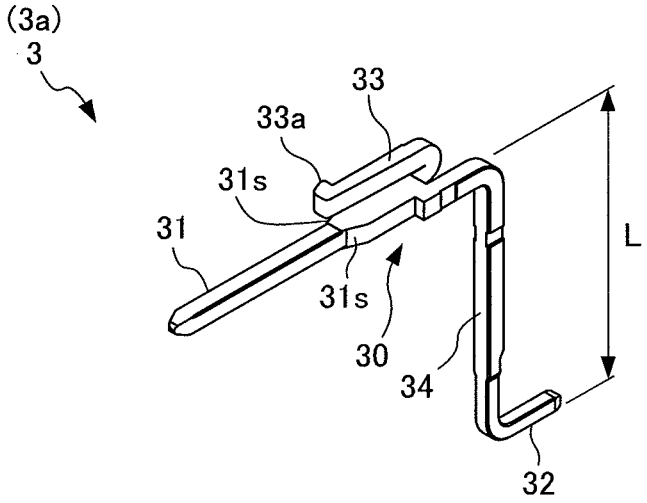
FIG. 7 is a perspective view of the contact equipped on the printed circuit board connector according to the first embodiment.

FIG. 5 is a plan view of the printed circuit board connector according to the first embodiment, showing a cross-section of the housing. FIG. 6 is an expanded perspective view of an essential portion of FIG. 4. FIG. 7 is a perspective view of the contact equipped on the printed circuit board connector according to the first embodiment.

The following refers to FIGS. 1 to 3. The printed circuit board connector 10 (hereinafter referred to as the connector) according to the first embodiment of the present invention is equipped with a parallelepiped housing 1, and a plurality of plate-shaped contacts 3. These contacts 3 are arranged in parallel in the housing 1. Also, the connector 10 is mounted on a surface lip of the printed circuit board 1*p*.

The following refers to FIGS. 2 to 5. The housing 1 has an insertion chamber 11 and a plurality of contact insertion holes 12. One surface la of the housing 1 is open in the insertion chamber 11, so that a mating-side connector header, not shown, can be inserted. Another surface 1*b* of the housing 1 is open in the contact insertion holes 12, in a direction opposite to the insertion chamber opening. Also the contact insertion holes 12 penetrate the insertion chamber 11. Also, contacts 3 can be inserted into the contact insertion holes 12 from another surface 1*b* of the housing 1.

The following refers to FIGS. 2 to 7. The contacts 3 have a base portion 30, a contact-connecting portion 31 and a lead portion 32. The base portion 30 is held inside the contact insertion portion 12. (See FIG. 4 or 5.) The width of the contact-connecting portion 31 is narrower than the base portion 30; the contact-connecting portion 31 is disposed to project into the insertion chamber 11, extending from the base portion 30 toward one end side. (See FIG. 4 or 5.) Also, the contact-connecting portion 31 connects with the mating-side contact, not shown.

The following refers to FIGS. 1 to 3. On the lead portion 32, another end side of the base portion 30 is bent, and extends toward the housing 1 bottom surface 1*c*. The lead portion 32, bent again, extends parallel to the contact-connecting portion 31 to an opposite side of the contact-connecting portion 31. Also, the lead portion 32 is solder-bonded to the printed circuit board 1*p* surface 11*p*.

The following refers to FIGS. 1 to 3. The connector 10 is further equipped with an L-shaped pair of reinforcing tabs 5*a*, 5*b*, disposed at both side surfaces 1*d*, 1*e* of the housing 1. These reinforcing tabs 5*a*, 5*b* are composed of metal plates. They are composed of a T-shape latching piece 51, and a bent piece 52 formed by bending a portion of the latching piece 51 at a right angle. Also, the pair of reinforcing tabs 5*a*, 5*b* is disposed on both side surfaces 1*d*, 1*e* of the housing 1 so that these bent pieces 52, 52 project in opposite directions. Note that the pair of reinforcing tabs 5*a*, 5*b* is the same article. However, for the sake of the convenience of the explanation, the symbols are different.

The following refers to FIGS. 2, 3 and 5. The housing 1 side surface 1*d* is formed with a frame 11*d* having opposing slit-shaped grooves. In the same way, frame 11*e* having opposing slit-shaped grooves is formed on the side surface 1*e* of the housing 1. Also, the latching pieces 51 are pressed into these frames 11*d*, 11*e*, thereby fastening the pair of reinforcing tabs 5*a*, 5*b* to the housing 1. Also, joint strength of the housing 1 to the printed circuit board 1*p* is reinforced by solder-bonding to the printed circuit board 1*p* surface 11*p* the bent pieces 52 of the pair of reinforcing tabs 5*a*, 5*b*.

The following refers to FIGS. 2, or 6 and 7. The contacts 3 are equipped with contact lances 33 that configure the first engaging member. The contact lances 33 extend substantially parallel to the base portion 30, from another end side of the base portion 30 to one end side. Also, the contact lances 33 are equipped on a leading end portion thereof with a hook-shaped latching piece 33*a*.

The following refers to FIGS. 2, or 5 and 6. Conversely, the contact insertion holes 12 communicate with the elongated holes 12*a*. The elongated holes 12*a* have at the back, levels 12*b* composed of the second engaging member. The contact lances 33 are inserted into the elongated holes 12*a*. This enables the levels 12*b* formed at the back of the elongated holes 12*a* and the latching pieces 33*a* of the contact lances 33 to lock (locking means).

The following refers to FIGS. 1, or 2 and 5. The plurality of contact insertion holes 12 includes a first contact insertion hole group A1 and a second contact insertion hole group A2.

The plurality of contact insertion holes 12 is arranged in a line on a top level of another surface 1*b* of the housing 1, in the first contact insertion hole group A1. The plurality of contact insertion holes 12 is arranged in a line on a bottom level of another surface 1*b* of the housing 2, in the second contact insertion hole group A2. Also, the first contact insertion hole group A1 and the second contact insertion hole group A2 have a relationship where the elongated holes 12*a* are positioned differently left and right, and the contacts 3*a* and 3*b* that have different leg portion lengths are arranged alternately.

The following refers to FIG. 2. The plurality of contacts 3 includes the first contact 3*a* and the second contact 3*b*. The contact lance 33 and lead portion 32 oppose each other, on the first contacts 3*a* and second contacts 3*b*. Each of the first contacts 3*a* is inserted into a contact insertion hole 12 in the first contact insertion hole group A1 disposed at the top level. For that reason, the length L (see FIG. 7) of the leg portion 34 leading from the base portion 30 to the lead portion 32 is longer. Each of the second contacts 3*b* is each inserted into a contact insertion hole 12 in the second contact insertion hole group A2 disposed at the bottom level. For that reason, the length L of the leg portion 34 leading from the base portion 30 to the lead portion 32 is shorter. The lead portions 32 alternately arranged with the first contact 3*a* and the second contact 3*b* are lined up and solder-bonded (see FIGS. 1 to 3) to the printed circuit board 1*p* surface 11*p*.

Actions of the Printed Circuit Board Connector

Actions and effects of the connector 10 of the first embodiment will now be explained. The following refers to FIG. 2 or 6. The base portions 30 of the contacts 3, and the housing 1 have a contact lance 33 and level 12*b* so the contact 33 does not move in an inserting direction or a reverse direction to the contact insertion holes 12.

The following still refers to FIG. 2 or 6. When contacts 3 are inserted into the contact insertion holes 12, with the contact-connecting portion 31 at the front, the contact lance 33 touches the inner wall of one of the elongated holes 12*a*, elastically deforming the contact lance 33. Still further, when the contact 3 is inserted into the contact insertion hole 12 until the shoulder 31*s* (see FIG. 7) disposed at the base-end portion of the contact-connecting portion 31 abuts the back of the contact insertion holes 12, the contact 3 stops. Also, at this point, the contact lance 33 elastically returns, locking the latching pieces 33*a* in the level 12*b*.

In this way, the contact 3 has a contact lance 33 that locks in the level 12*b* disposed in the contact insertion hole 12. For that reason, the contact 3 is prevented from moving in an insertion direction and a reverse direction to the contact insertion holes 12 by pressing the mating-side contact (not shown).

The following refers to FIG. 2 or 6. The contact lance 33 and the level 12*b* swingably hold contact 3 base portion 30 inside the contact insertion hole 12, so that the lead portion 32 can approach or separate from the printed circuit board 1*p* surface 11*p*.

The following refers to FIGS. 1 to 7. The connector 10 according to the first embodiment is composed of the housing 1 and the contacts 3, as described above. For that reason, if the housing 1 bottom surface 1*c* is slightly curved toward an inside in a concave shape, for example, the lead portion 32 positioned near the center of the housing 1 can move close to the printed circuit board 1*p* surface 11*p*, and the lead portion 32 positioned near both side surfaces 1*d* and 1*e* of the housing 1 can move to separate from the printed circuit board 1*p* surface 11*p*.

The following refers to FIG. 1 or 2. It is conceivable that a force in the melted solder acts on the lead portion 32 attracting it to the pad side on the printed circuit board 1*p* where lead portions 32 are solder-bonded to pads on the printed circuit board. The connector 10 according to the first embodiment, therefore, can be considered to be self-aligning.

The connector 10 according to the first embodiment is structured to hold a plurality of contacts 3 having lead portions 32 solder-bonded to the printed circuit board 1*p*, swingable in only one direction on the printed circuit board 1*p*. For that reason, the plurality of lead portions 32 solder-bonding surfaces are solder-bonded along a warping or twisting occurs, and absorb manufacturing error caused by warping or torsion of the housing 1 or printed circuit board 1*p*. Also, it is possible to reduce the effect of the lead portion 32 solder-bonding strength. Specifically, mounting quality of the connector 10 of the first embodiment is improved.

Also, with reference to FIGS. 1, 2, and 5, the connector 10 according to the first embodiment is formed to alternately arrange first contacts 3*a* having long leg portions from the base portion 30 to the lead portion 32, that are inserted into each of the contact insertion holes 12 of the first contact insertion hole group A1, and second contacts 3*b* having short leg portions 34 from the base portion 30 to the lead portion 32, that are inserted into each of the contact insertion holes 12 of the second contact insertion hole group A2. For that reason, the arrangement of contacts 3 has a narrow-pitch enabling a plurality of contacts 3 to be arranged.

Second Embodiment

Printed Circuit Board Connector Configuration

Figure 8:
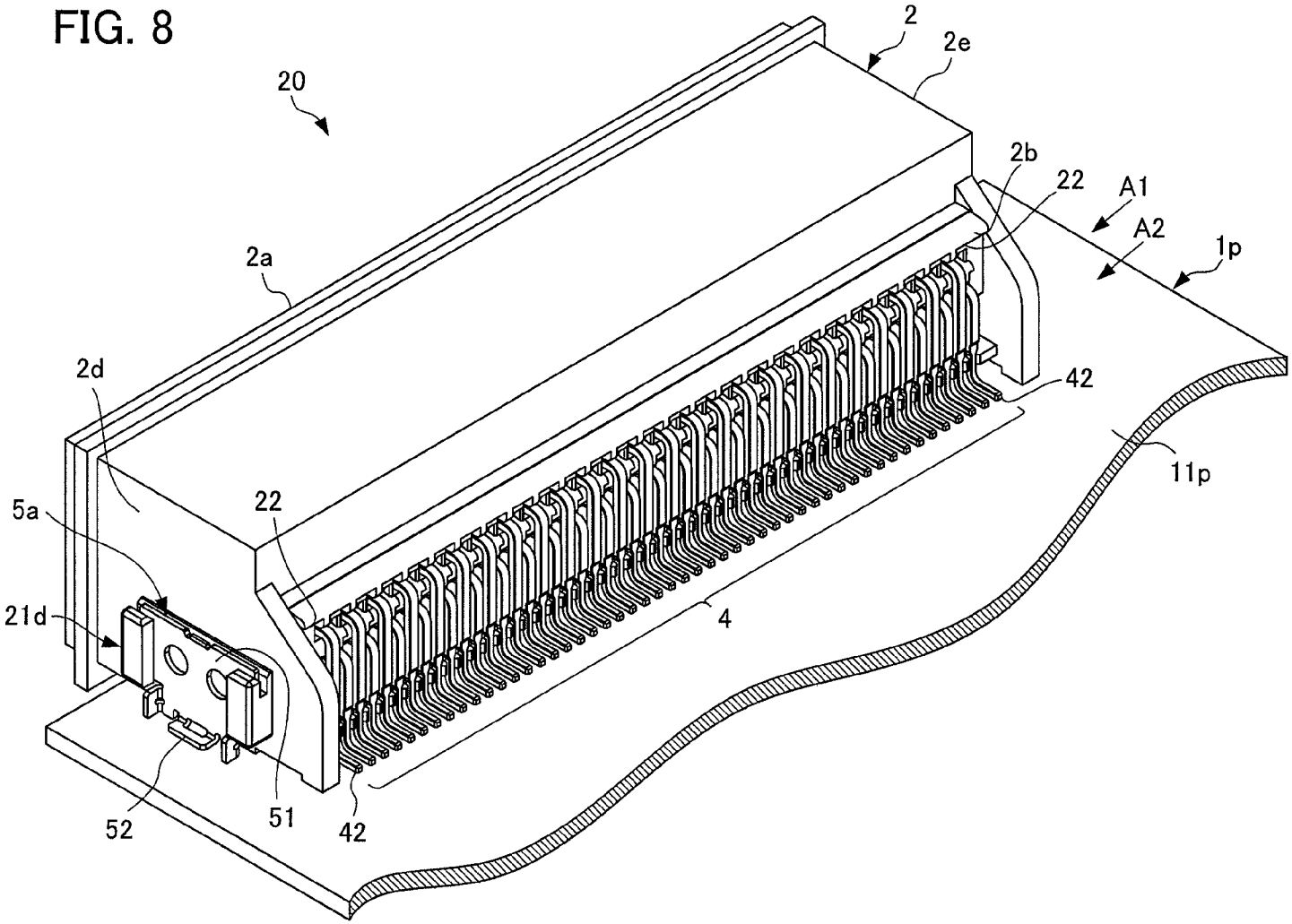
FIG. 8 is a perspective view of a printed circuit board connector configuration according to a second embodiment of the present invention with the printed circuit board connector seen from a top surface side.
Figure 9:
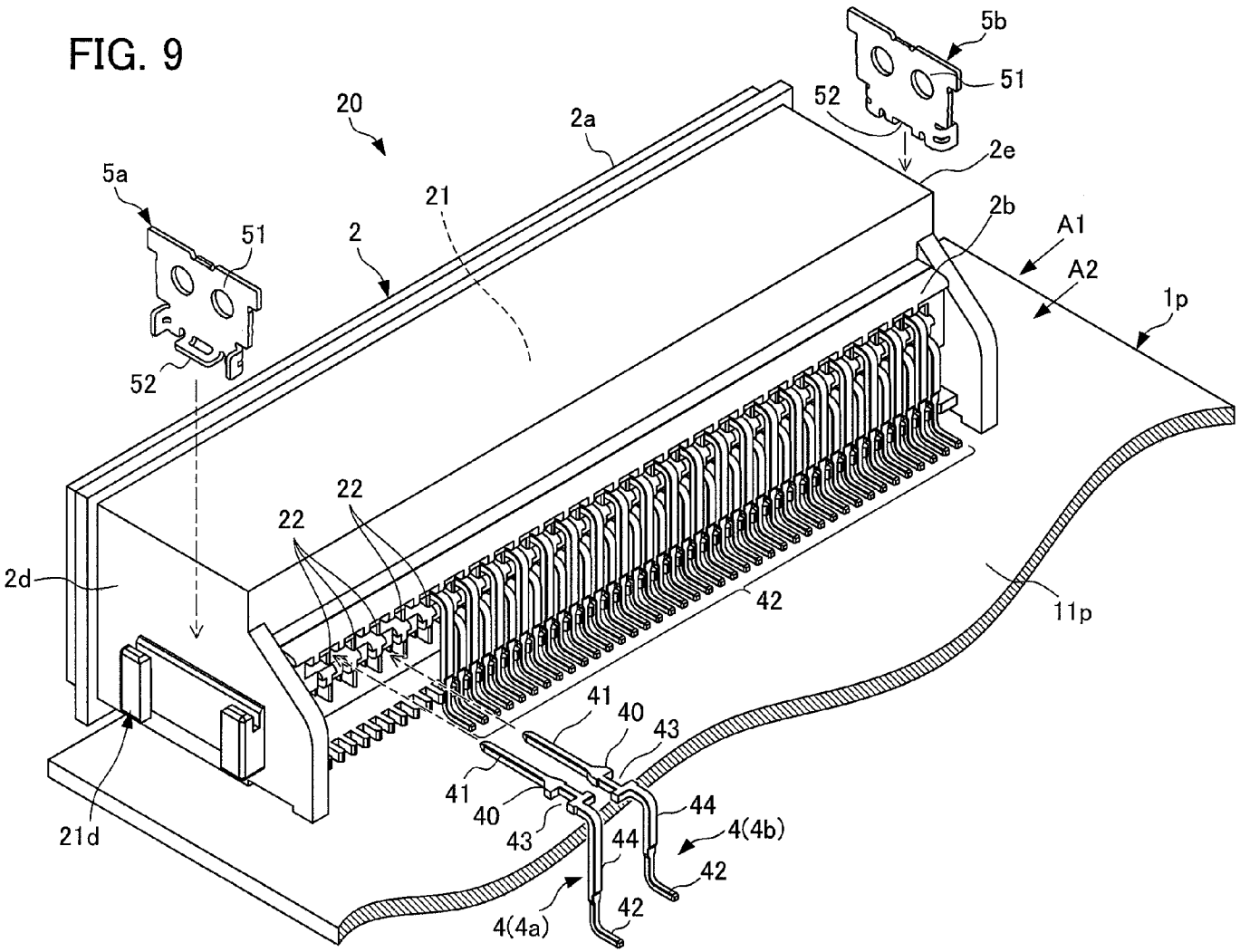
FIG. 9 is an exploded perspective view of the printed circuit board connector configuration according to the second embodiment with the printed circuit board connector seen from a top surface side.

The printed circuit board connector configuration according the second embodiment of the present invention will now be explained. FIG. 8 is a perspective view of a printed circuit board connector configuration according to the second embodiment of the present invention with the printed circuit board connector seen from a top surface side. FIG. 9 is an exploded perspective view of the printed circuit board connector configuration according to the second embodiment with the printed circuit board connector seen from a top surface side.

Figure 10:
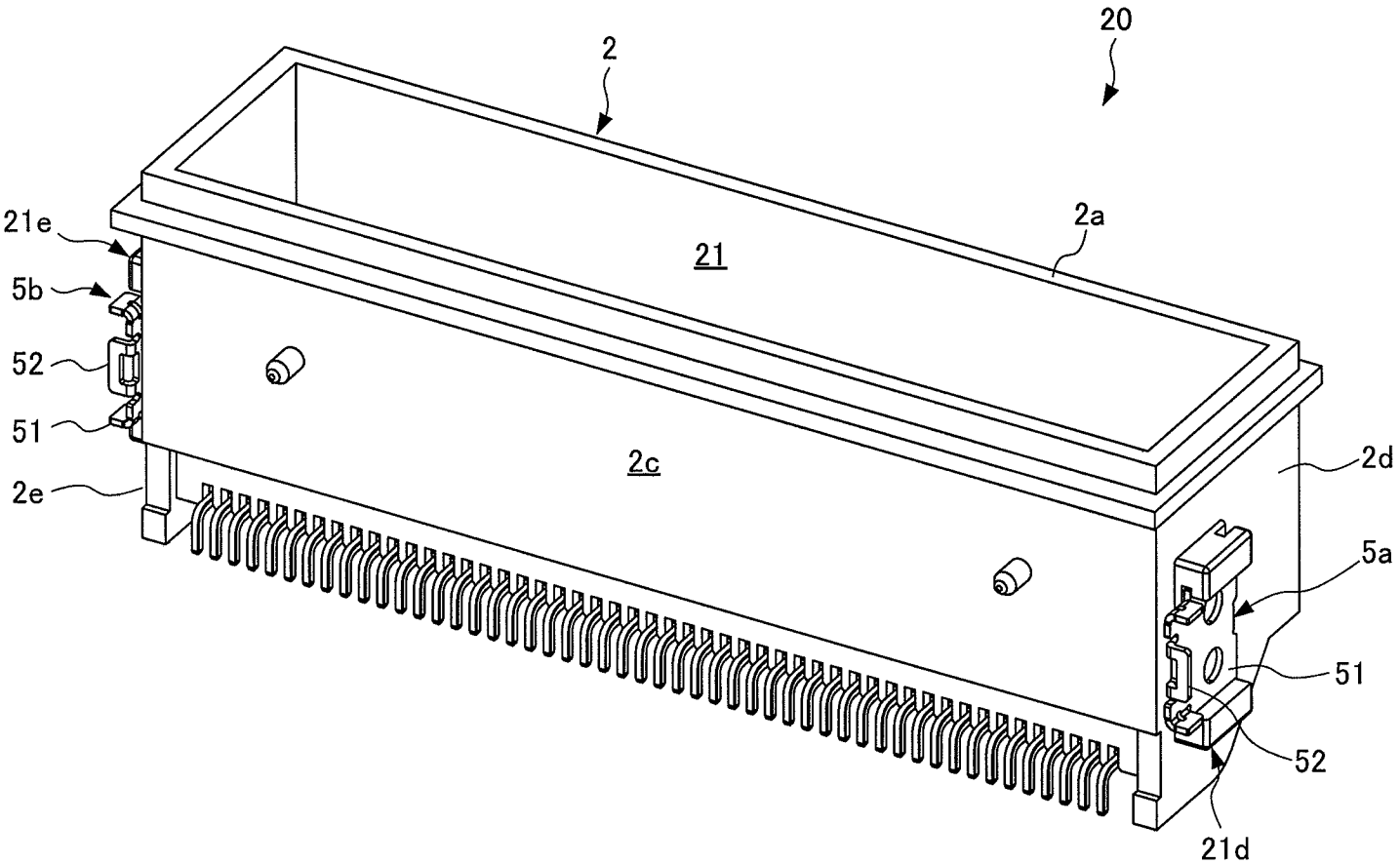
FIG. 10 is a perspective view of the printed circuit board connector configuration according to the second embodiment with the printed circuit board connector seen from a bottom surface side.
Figure 11:
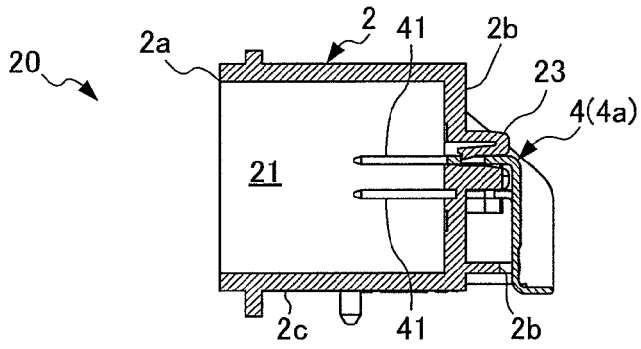
FIG. 11 is a longitudinal section profile view of the printed circuit board connector according to the second embodiment cut along a first contact.
Figure 12:
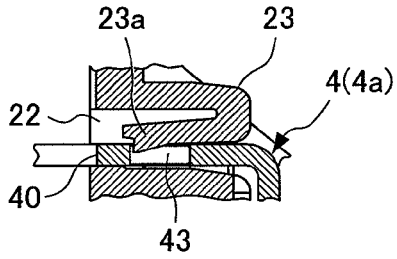
FIG. 12 is an expanded longitudinal section profile view of an essential portion of FIG. 11.

FIG. 10 is a perspective view of the printed circuit board connector configuration according to the second embodiment with the printed circuit board connector seen from a bottom surface side. FIG. 11 is a longitudinal section profile view of the printed circuit board connector according to the second embodiment cut along a first contact. FIG. 12 is an expanded longitudinal section profile view of an essential portion of FIG. 11.

Figure 13:
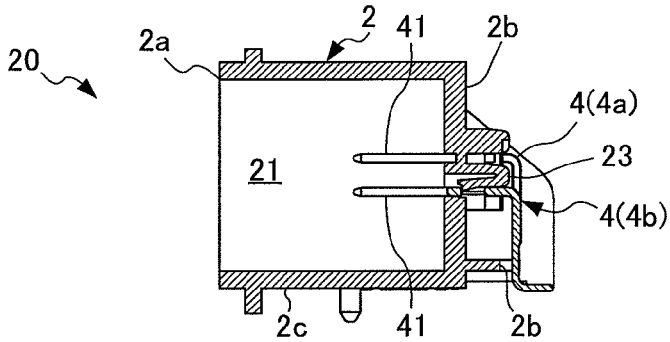
FIG. 13 is a longitudinal section profile view of the printed circuit board connector according to the second embodiment cut along a second contact.
Figure 14:
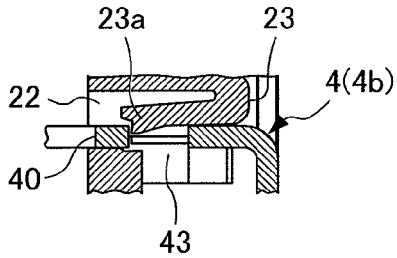
FIG. 14 is an expanded longitudinal section profile view of an essential portion of FIG. 13.
Figure 15A:
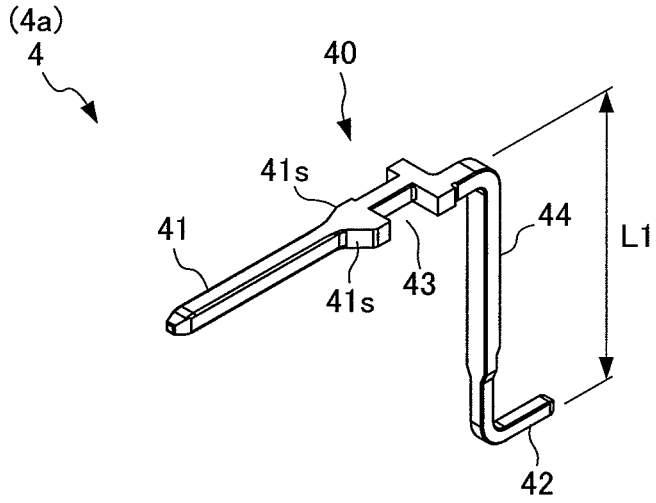
FIGS. 15A and 15B are perspective views of the contact equipped on the printed circuit board connector according to the second embodiment.
Figure 15B:
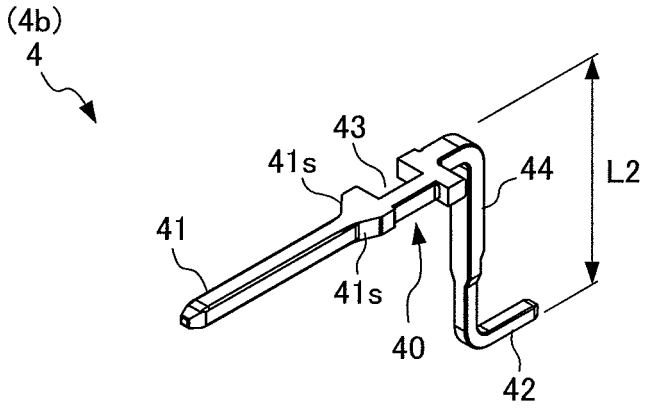
Figure 16:
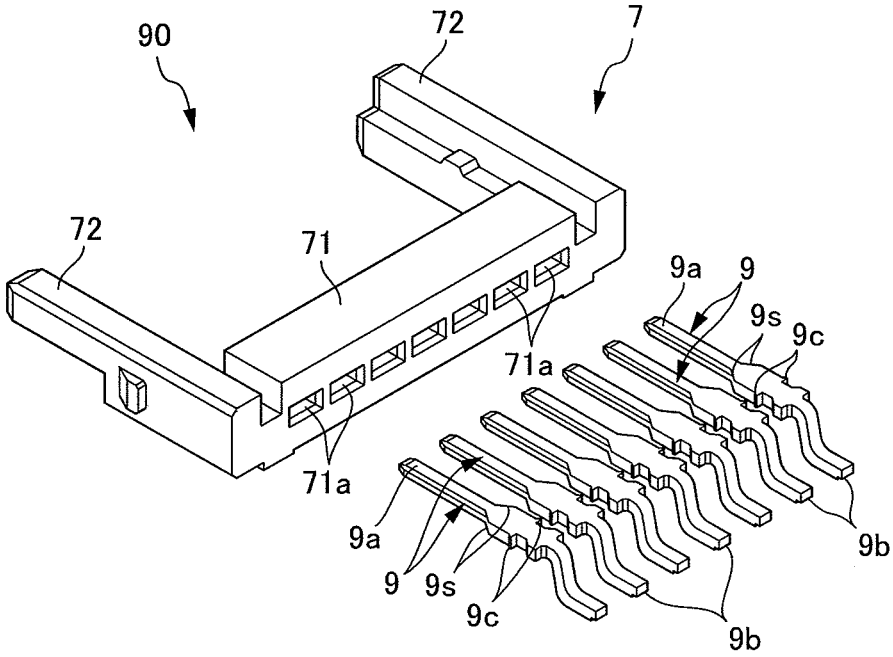
FIG. 16 (PRIOR ART)
FIG. 16 is an exploded perspective assembly view of a printed circuit board connector according to the prior art, showing a housing and a contact opposingly disposed.

FIG. 13 is a longitudinal section profile view of the printed circuit board connector according to the second embodiment cut along a second contact. FIG. 14 is an expanded longitudinal section profile view of an essential portion of FIG. 13. FIGS. 15A and 15B are perspective views of the contact equipped on the printed circuit board connector according to the second embodiment. FIG. 15A is a perspective view of the first contact; FIG. 15B is a perspective view of the second contact. Note that the configuring elements having the same symbols as those used in the explanation of the first embodiment and their behavior is the same, so in some instances, any further description is omitted.

The following refers to FIGS. 8 to 10. The connector 20 according to the second embodiment of the present invention is equipped with a parallelepiped housing 2, and a plurality of plate-shaped contacts 4. Contacts 4 are arranged in parallel in the housing 2. Also, the connector 20 is mounted on a surface 11*p* of the printed circuit board 1*p*.

The following refers to FIGS. 8 to 10, or 11 and 13. The housing 2 has an insertion chamber 21 and a plurality of contact insertion holes 22. One surface 2*a* of the housing 2 is open in the insertion chamber 21, so that a mating-side connector header, not shown, can be inserted. Another surface 2*b* of the housing 2 is open for the contact insertion holes 22, in a direction opposite to the insertion chamber opening. Also the contact insertion holes 22 penetrate the insertion chamber 21. Also, contacts 4 can be inserted into the contact insertion holes 22 from another surface 2*b* of the housing 2.

The following refers to FIGS. 9, or 15A and 15B. The contacts 4 have a base portion 40, a contact-connecting portion 41 and a lead portion 42. The base portion 40 is held inside the contact insertion portion 22. (See FIG. 12 or 14.) The width of the contact-connecting portion 41 is narrower than the base portion 40; the contact-connecting portion 41 is disposed to project into the insertion chamber 21, extending from the base portion 40 to one end side. (See FIG. 11 or 13.) Also, the contact-connecting portion 41 connects with the mating-side contact, not shown.

The following refers to FIGS. 8 to 10. On the lead portion 42, another end side of the base portion 40 is bent, and extends toward the housing 2 bottom surface 2*c*. The lead portion 42, bent again, extends parallel to the contact-connecting portion 41 and to the contact-connecting portion 41 to an opposite side. Also, the lead portion 42 is solder-bonded to the printed circuit board 1*p* surface 11*p*.

The following refers to FIGS. 8 to 10. The connector 20 is further equipped with an L-shaped pair of reinforcing tabs 5*a*, 5*b*, disposed at both side surfaces 2*d*, 2*e* of the housing 2. Frame 21*d* having opposing slit-shaped grooves is formed on the side surface 2*e* of the housing 2. In the same way, frame 21*e* having opposing slit-shaped grooves is formed on the side surface 2*e* of the housing 2. Also, the latching pieces 51 are pressed into these frames 21*d*, 21*e*, to fasten the pair of reinforcing tabs 5*a*, 5*b* to the housing 2. Also, joint strength of the housing 2 to the printed circuit board 1*p* is reinforced by solder-bonding to the printed circuit board 1*p* surface 11*p* the bent pieces 52 of the pair of reinforcing tabs 5*a*, 5*b*.

The following refers to FIGS. 11 to 14. The housing 2 has a housing lance 23 that composes the third engaging member. The housing lance 23 projects from another face 2*b* of the housing 2 and turns over to oppose an inner wall of the contact insertion holes 22. Also, the housing lances 23 are equipped on a leading end tip thereof with a hook-shaped latching piece 23*a*.

The following refers to FIGS. 12, or 14 and 15A and 15B. Conversely, the contacts 4 have a rectangular notched portion 43 that composes the fourth engaging member. The notched portion 43 is partially formed on the base portion 40. More specifically, the notched portion 43 is formed on one side of the base portion 40. Also, the latching piece 23*a* is formed inside the contact insertion holes 22. With this configuration, when the contact 4 is inserted into the contact insertion holes 22, the latching piece 23*a* locks onto an inner edge of the notched portion 43 of the contact 4 (locking means).

The following refers to FIGS. 8 or 9, and 11 to 14. The plurality of contact insertion holes 22 includes the first contact insertion hole group A1 and the second contact insertion hole group A2. The plurality of contact insertion holes 22 is arranged in a line on a top level of another surface 2*b* of the housing 2, in the first contact insertion hole group A1. The plurality of contact insertion holes 22 is arranged in a line on a bottom level of another surface 2*b* of the housing 2, in the second contact insertion hole group A2. Also, the first contact insertion hole group A1 and the second contact insertion hole group A2 have a relationship where the housing lance 23 positions are different on the left and right. The contacts 4*a* and 4*b* have different leg portion lengths, and are arranged alternately.

The following refers to FIGS. 9 or 15A and 15B. The plurality of contacts 4 includes the first contact 4*a* and the second contact 4*b*. With regard to the first contact 4*a* and the second contact 4*b*, the positions of the notched portions 43 formed on one side of the base portion 40 are mutually opposed. The first contact 4*a* is each inserted into the contact insertion holes 32 in the first contact insertion hole group A1 disposed at the top level. For that reason, the length L1 (see FIG. 15A) of the leg portion 44 leading from the base portion 40 to the lead portion 42 is longer. The second contact 4*b* is each inserted into the contact insertion holes 22 in the second contact insertion hole group A2. For that reason, the length L2 (see FIG. 15A) of the leg portion 44 leading from the base portion 40 to the lead portion 42 is shorter. Also, the lead portions 42 alternately arranged with the first contact 4*a* and the second contact 4*b* are lined up and solder-bonded (see FIGS. 8 to 10) to the printed circuit board 1*p* surface 11*p*.

Actions of the Printed Circuit Board Connector

Actions and effects of the connector 20 of the second embodiment will now be explained. The following refers to FIGS. 9, or 11 to 14. The housing 2 and the base portion 40 of the contacts 4 have a housing lance 23 and notched portion 43. For that reason, the contact 4 does not move in an inserting direction to the contact insertion holes 22 and a reverse direction.

The following refers to FIGS. 9, or 11 to 14. When the contacts 9 are inserted into the contact insertion holes 22, with the contact-connecting portion 41 at the front, the contact-connecting portion 41 touches the housing lance 23, elastically deforming the housing lance 23. Still further, when the contact 4 is inserted into the contact insertion hole 22 until the shoulder 41*s* (see FIGS. 15A and 15B) disposed on the based end portion of the contact-connecting portion 41 abuts the back of the contact insertion holes 22, the contact 4 stops. Also, at this point, the housing lances 23 elastically returns, thereby locking the latching pieces 23*a* in the notched portion 43 inner edge.

In this way, the housing 2 has a housing lance 23 that locks in the notched portion 43 partially established in the base portion 40 of the contact 4. For that reason, the contact 4 is prevented from moving in an insertion direction to the contact insertion holes 22 and a reverse direction by pressing the mating-side contact (not shown).

The following refers to FIGS. 9, or 11 to 14. The housing lance 23 and the contact 4 base portion 40 are swingably held inside the contact insertion holes 22. For that reason, that the lead portions 42 approach and separate from the printed circuit board 1*p* surface 11*p*.

The following refers to FIGS. 8 to 15A and 15B. The connector 20 according to the second embodiment is configured by the housing 2 and the contacts 4, as described above. For that reason, if the housing 2 bottom surface 2*c* is slightly curved to an inside in a concave shape, for example, the lead portion 42 positioned near the center of the housing 2 can move close to the printed circuit board 1*p* surface 11*p*, and the lead portion 42 positioned near both side surfaces 2*d* and 2*e* of the housing 2 can separate from the printed circuit board 1*p* surface 11*p*.

The connector 20 according to the second embodiment is structured to hold a plurality of contacts 4 having lead portions 42 solder-bonded to the printed circuit board 1*p*, swingable in only one direction on the printed circuit board 1*p*. For that reason, the plurality of lead portions 42 solder-bonding surfaces are solder-bonded along a warping or twisting that occurs, and absorb manufacturing error caused by warping or torsion of the housing 2 or printed circuit board 1*p*. Also, it is possible to reduce the effect of the lead portion 42 solder-bonding strength. Specifically, mounting quality of the connector 20 of the second embodiment is improved.

The printed circuit board connector according to the present invention is structured swingably to hold a plurality of mutually independent contacts. For that reason, the plurality of lead portion solder-bonding surfaces are securely solder-bonded along warping or twisting that occurs, and absorbs manufacturing error caused by warping or torsion of the housing or printed circuit board.

Horizontally attached connectors (also called side-type connectors) were disclosed, mounted so that the coupling direction to a printed circuit board of one set of connectors is horizontal for the connectors 10 and 20 of the first and the second embodiments. However, this can also be applied to vertically attached connectors (also called top-type connectors) mounted so that the coupling direction to a printed circuit board of one set of connectors is vertical.

What is claimed is:

1. A printed circuit board connector equipped with a housing, and a plurality of plate-shaped connectors arranged in parallel in the housing, wherein the housing includes an insertion chamber one surface thereof open to enable insertion of a mating-side connector;

a contact-insertion hole open in a direction opposite to the insertion chamber opening, penetrating the insertion chamber, and can be inserted therein by the connectors, the connectors include a base portion held inside the connector-insertion hole;

contact-connecting portion a width thereof being narrower than the base portion, disposed to project into the insertion chamber, extending to one end side from the base portion;

a lead portion, one end side of the base portion bent and extending toward a bottom surface side of the housing, further bent to extend in parallel to the contact-connecting portion in a direction opposite to the contact-connecting portion, solder-bonded to a surface of the printed circuit board; and locking means that mutually engage the contact base portion and the housing so that the contact does not move in an insertion direction to the contact insertion hole or a reverse direction; and the locking means swingably holds the contact base portion inside the contact insertion hole so that lead portions approach and separate from the printed circuit board surface.

2. The printed circuit board connector according to claim 1, wherein the locking means includes a first engaging member that is equipped with a contact lance extending substantially parallel to the base portion from one end side of the base portion to another end side, equipped at a leading end portion with a hook-shaped latching piece; and a second engaging member that communicates with the contact-insertion hole, and is equipped in the housing with a level that is engaged by the latching piece, formed with an elongated hole that is inserted by the contact lance, formed at a back of the elongated hole.

3. The printed circuit board connector according to claim 1, wherein the locking means includes a third locking means that projects from another face of the housing, and disposes on the a housing lance that turns over to oppose an inner wall of the contact insertion holes, and a fourth locking means partially formed in the base portion, that disposes on the contact a rectangular notch portion that can be engaged by a leading end portion of the housing lance.

4. The printed circuit board connector according to claim 1, wherein a plurality of contacts-insertion holes is disposed, and includes a first contact insertion hole group arranged with a plurality of the contact-insertion holes in a line at a top level of another surface of the housing; and a second contact insertion hole group arranged with a plurality of the contact-insertion holes in a line at a bottom level of another surface of the housing;

the contacts are disposed in plurality, a first contact inserted into each contact-insertion hole of the first contact insertion hole group, and whose leg portion from the base portion to the lead portion is long; and a second contact inserted into each contact-insertion hole of the second contact insertion hole group, and whose leg portion from the base portion to the lead portion is short;

an end portion of the base portion including the leg portion and the lead portion on the first contact and the second contact are alternately arranged.

* * * * *